US006105812A

United States Patent [19]

Riordan

[11] Patent Number: 6,105,812

[45] Date of Patent: Aug. 22, 2000

[54] DUAL CHAMBER CONTAINER

[76] Inventor: Dennis Riordan, 74 Foltim Way, Congers, N.Y. 10920-1423

[21] Appl. No.: 09/234,537

[22] Filed: Jan. 21, 1999

[51] Int. Cl.[7] ..... B65D 1/04

[52] U.S. Cl. ..... 220/504; 215/6; 220/916; 220/633

[58] Field of Search ..... 215/6, 2; 220/504, 220/916, 634, 633, 635

[56] References Cited

U.S. PATENT DOCUMENTS

| | | | |
|---|---|---|---|
| 1,635,070 | 7/1927 | Clark | 215/2 |
| 2,611,499 | 9/1952 | Mayer . | |
| 3,200,998 | 8/1965 | Mahar | 220/633 |
| 3,327,881 | 6/1967 | Maier | 215/6 |
| 3,465,905 | 9/1969 | Schottanes | 215/6 |
| 4,603,784 | 8/1986 | Chang | 215/11.1 |
| 5,803,268 | 9/1998 | Levy et al. | 206/581 |

FOREIGN PATENT DOCUMENTS

| | | | |
|---|---|---|---|
| 2127376A | 4/1984 | United Kingdom | 220/504 |

*Primary Examiner*—Stephen Castellano
*Attorney, Agent, or Firm*—W. Patrick Quast, Esq.

[57] ABSTRACT

A dual chamber container is described. A centrally positioned cone shaped divider separates the volume of the container into two equal sections so as to better preserve beverage carbonation and therefore beverage flavor over a longer period of time. The unique shape and placement of the divider within the container also distributes the weight of the contents so as to prevent "top heaviness". The container is cylindrical in shape with parallel symmetrical ends for stability when standing upright at either end. A centrally positioned spout with threaded cap is situated at both ends within a well area formed by extensions of the cylindrical wall portion of the container. A convenient pour arch and two finger carry aperture is formed within the walls at the well area at both ends. Bottle stability is increased together with spill protection, easy pouring, and convenient portability.

12 Claims, 5 Drawing Sheets

DUAL CHAMBER CONTAINER

BACKGROUND

This invention relates to containers, and in particular to dual chamber containers for securing drinks such as carbonated beverages other comestibles, and other flowing items.

In today's marketplace for drinks such as colas, ginger ale, and beer, aluminum cans and either glass or plastic bottles are the containers of choice. Inevitably, opening these containers releases a portion of the original carbonation. Unless the entire contents of the container are consumed immediately, repeated opening and closing of the container results in a loss of carbonation, additionally causing a loss of original, fresh flavor. This is especially true in the case of current two liter plastic beverage bottles, with customers routinely complaining that a portion of the beverage has gone "flat" before the two liter contents are consumed.

Additionally, single content containers impose limitations overcome by dual chamber containers for juices, foods, detergents, and spreads as will be more fully discussed below.

Various devices and methods have been proposed for dual chamber containers as is evident from U.S. Pat. No. 1,634,569, issued Jul. 5, 1927. This patent teaches a reversible ice cream can which includes an intermediate partition to join to the inside of the can by means of a double or forked edge 3 (FIG. 1) to best provide two chambers, each having a dished bottom. Again, U.S. Pat. No. 2,611,499, issued Sep. 23, 1952, discloses a double container receptacle which enhances the interface between the two compartments by utilizing various intervening members so that the so-called "head space" or entrapped air has different aesthetic qualities, particularly when liquids of different colors are combined. Further, U.S. Pat. No. 5,279,841, issued Jan. 18, 1994, discloses a dual container connecting ring 4 (FIG. 2) for connecting two metal cans together in an easily separable manner. Doing so permits utilizing smaller cans to help preserve flavor when consuming a drink, and also to provide a variety of easily carried combinations of canned comestibles. A variety of methods are disclosed for joining the cans together, including a "a thin shrinkable transparent polyester tubing to hold these cans tightly to form an united container", (col. 4, lines 62—62). Additionally, U.S. Pat. No. 5,499,738, issued Mar. 19, 1996, disclosed a dual container for holding pressurized liquids. The invention describes a cylindrical plastic container 1 with a double-ended bottle shape having a central divider 2 which divides the interior of the container into two separate compartments 3 and 4 (FIG. 1). A detachable plastic stand 7 (FIG. 1) secures the bottle in upright position when not in use. An alternative embodiment discloses an aluminum can 16 (FIG. 5) with a central divider 17 (FIG. 5), with the flat ends of the can providing upright stability when not in use. Again, in U.S. Pat. No. 5,630,523, issued May 20, 1997, interconnected containers as described. In this invention an "upper" container 10 connects to a "lower" container 12 (FIG. 1), wherein the "upper" container has a cavity in its bottom which has an annular friction shoulder, while the "lower" container has a protruding shoulder on its bottom comparable in size to the cavity on the "upper" container.

While the above cited inventions disclose useful devices and methods for dual containers they do not address the unique conveniences inherent in the present invention.

It is therefore a primary object of the invention to provide a dual chamber container with enhanced stability and wherein the container walls define the bottom plane for standing the container on either end.

An additional object of the invention is to provide greater stability for a dual chamber container while in a standing, upright position on either end.

A further object to provide a dual chamber container with symmetrical opposite ends containing a "neck-well area" to serve as a spill-guard.

An additional object is to provide a dual chamber container with symmetrical opposite end "neck-well area" having convenient easy-carry two finger apertures, and easy-pour arch construction.

Yet another object of the invention is to provide a dual chamber container compatible with current standard shipping requirements.

A further object is to provide a dual chamber container for conveniently "mix and matching" different types of beverages.

Yet another object of the invention is to provide a dual chamber container providing uniquely flexible packaging for many household combinations other than carbonated beverages and fluid comestibles.

It is still a further object of the invention to provide a dual chamber container wherein a container divider separates the two chambers and, by distributing the weight of the contents through the mid-section of the container, i.e. a lowering of the Center of Gravity, an enhancement of the container's stability is achieved.

SUMMARY

These and other objects are obtained with the dual chamber container of the present invention.

As has been noted above this invention is prompted by, although not exclusively connected with, the two liter capacity carbonated beverage container routinely seen in today's supermarkets. These popular containers provide an economical convenience for customers desiring a larger quantity of a particular beverage without troubling with a package containing multiple smaller containers. Unfortunately, this convenience carriers the price of frequent loss of flavor, as the customer removes the beverage, due to the escape of carbonation during bottle opening and closing procedures.

It occurred that the convenience of the two liter bottle can be maintained together with greatly enhanced flavor preservation by placing a divider within the bottle. Symmetrical openings to the divided container, at both ends, such as the typical threaded opening to the container and a cooperating threaded air tight cap, provide the customer with a freshly carbonated drink after the first liter has been consumed. An additional benefit is to refresh the "dregs" of the original liter with the fully carbonated beverage in the second compartment of the container through mixing.

A well area is provided at both ends of the container between extensions of the wall and the pour sprouts, when the cap is secured to the spout the upper surface of the cap lies in a plane below the edge of the ends of the cylindrical wall (approximately 1/16" to an 1/8"). In this manner the container can be posited in an upright position on either end when placed on a counter. The well area provides a spill-guard for the beverage, and in addition provides a convenient area for including an easy-pour arch configuration, and a two finger hold aperture at both end well areas.

For additional stability when the container is placed in an upright position, a uniquely designed and positioned divider is provided. Instead of extending in a parallel plane between the two spout caps at approximately the midpoint of the container, the divider of the present invention extends downward from an "upper" section of the container at an oblique angle from the inner wall of the container in a generally cone shaped configuration into a "lower" section of the container, dividing the container into an "upper" first section and a "lower" second section. In this manner weight is distributed within the container so as to prevent "top heaviness" when the container is placed in an upright position with the first section above the second section.

An example of a simplified method of fabrication is also discussed. In this method the container is fabricated in two main sections, a first or upper section having a circumferential "tongue" configuration at its outer periphery adjacent the beginning of a conically shaped divider, and with a second or lower section having a circumferential "groove" configuration in the inner all of the container adjacent the bottom edge (i.e., away from the "top" end where the spout cap is located) of this second section. The two sections can then be secured firmly together either with adhesive or heat sealing techniques well known to the art.

While the present invention has been described as a new convenience for two liter plastic bottles, it is to be understood that the invention is applicable to larger and smaller sizes of various containers. The cylindrical shape may be altered so as to form an oblong, rectangular, or square shape without departing from the scope of the invention. The described threaded cap spout closures can also be modified in any convenient conventional manner, e.g., twist spouts for comestibles such as mustard and ketchup, and, of course, metal or glass can be substituted for the described plastic fabrication.

The primary use for the present invention is to provide a way for preserving the flavor and "life" of carbonated beverages, but as can be readily seen the invention can also be employed for non-carbonated comestibles such as juices, foods, and spreads. The invention can be used as a space-saver for two different products, many often found in combination, such as, for example, mixed drinks, mustard and catsup, salt and pepper, etc. In addition the invention envisions conveniences for combinations of non-comestibles, such as household detergents, bleach and fabric softener, etc.

Thus it can be seen the present invention provides a unique, new convenience for carbonated beverages and a wide variety of household products. Unusual stability is provided for these normally cumbersome containers, by utilizing oppositely disposed symmetrical planar bases and a non-planar interface between dual chambers, together with well areas serving as a combination spill-guard, with easy-pour arch, and readily accessible carry handles.

DETAILED DESCRIPTION OF THE PREFERRED EMBODIMENT

Figure 1:
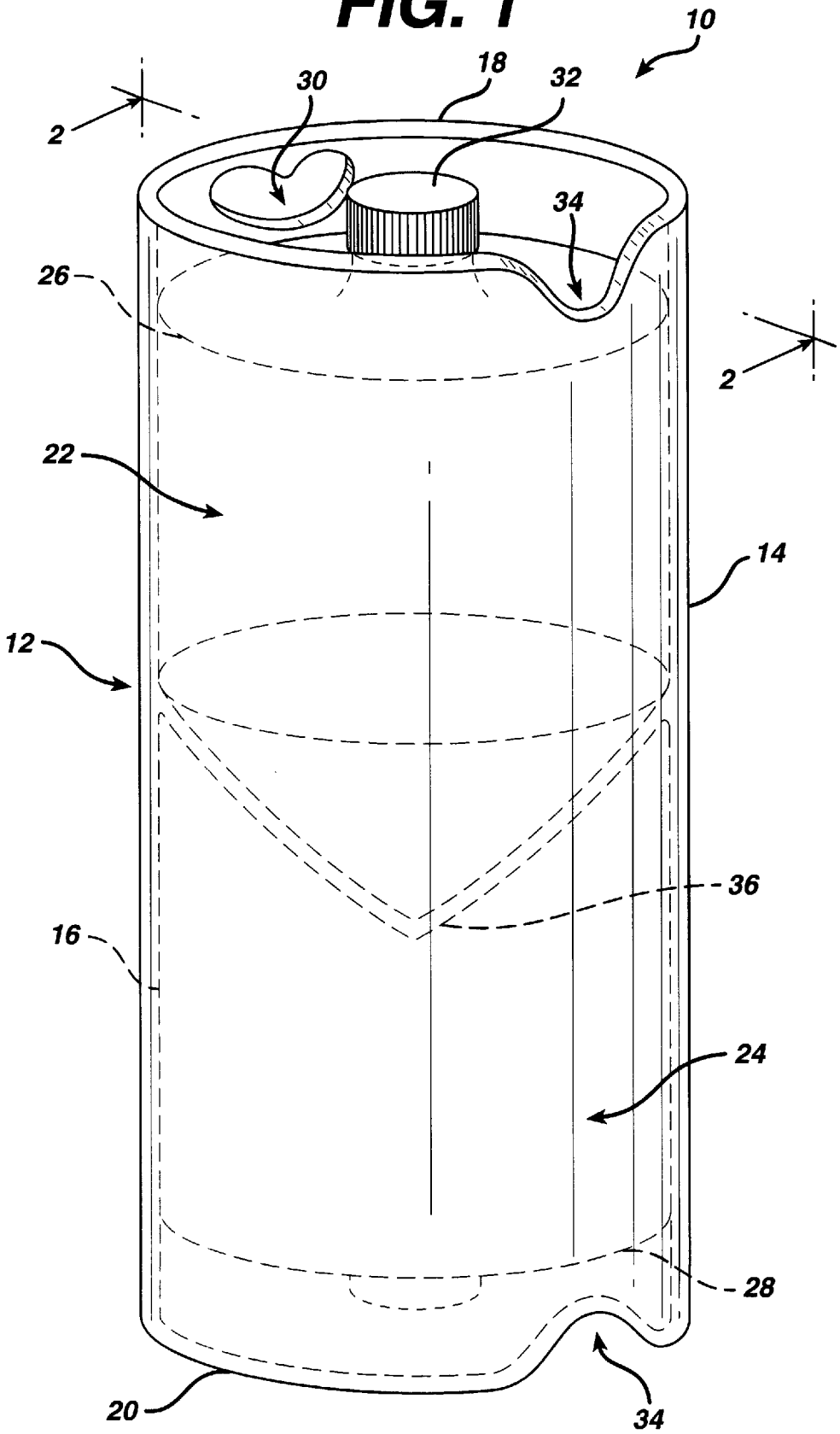
FIG. 1 is a perspective view of one version of the dual chamber container of the invention, with a neck well area and conical divider shown in phantom.
Figure 2:
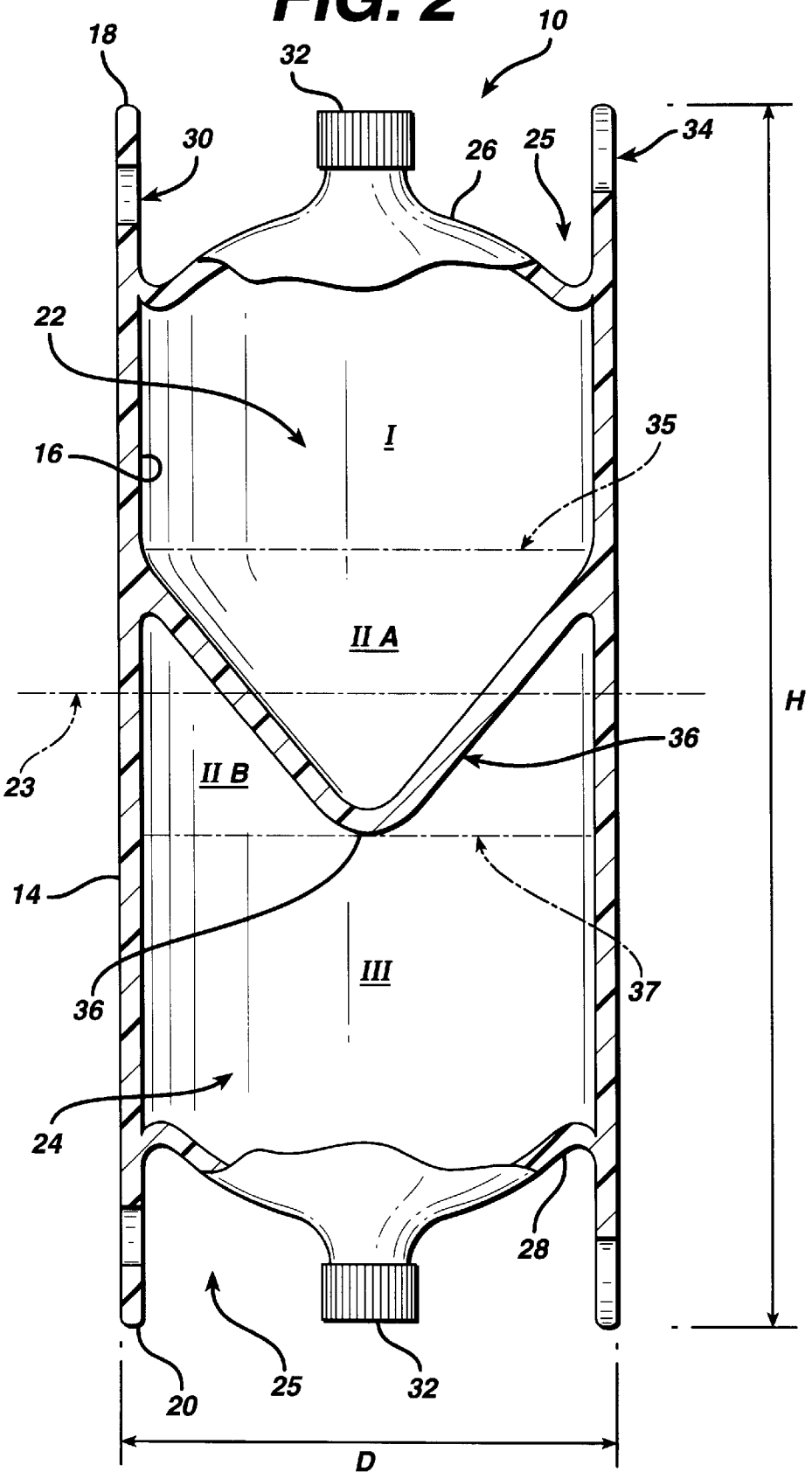
FIG. 2 is a partially sectional view of one version of the dual chamber container of the invention taken along the lines 2—2 of FIG. 1.

Turning now to the drawings wherein similar structures having the same function are denoted with the same numerals in the various views, in FIGS. 1 and 2 a version of the dual chamber container 10 of the invention is illustrated. In this version, the body portion of the container 10 includes a circumferentially, enclosing wall portion 14. It is shown as having a cylindrical shape 12 throughout its length. The overall height of the container 10 can be, for example, 12", with a width of approximately 4", which is the current size of a two liter bottle. By retaining these dimensions present shipping cartons can be used. Of course, other sizes can be employed.

The container has two substantially volumetrically equal sections, I, IIA and IIB, III, as seen in FIG. 2, separated by a divider 36. Volume IIA is the volume between the cone shaped divider 36 and the plane, 35, of the base of the cone. Volume IIB is the volume between the cone shaped divider 36 and a plane 37, parallel to the base plane 35, located at the apex. The volume of compartment IIA is substantially equal to the volume of compartment IIB. The divider is formed by a projection at the inner wall 16 of the container proceeding at an oblique angle in a downward direction (as viewed in FIGS. 1 and 2) from an "upper" or first section 22 to a "lower" or second section 24 within the container. Upper section 22 is the section of the container above the imaginary midpoint plane 23; while section 24 is the portion below that plane. The divider is generally cone shaped with the apex of the cone positioned at approximately the lateral midpoint between the vertical portions of the wall portion 14 of the container, the apex being located within the area of the second section 24 of the container. Shapes other than a cone, as, for example, an eclipse, hemisphere, or triangle, can also serve as the means for improved weight distribution of the contents. This conical divider and these other configurations effect a lowering of the center of gravity of the fluid or material with the upper section as contrasted to a straight across separation.

The volumes of the respective compartments can be altered to accommodate a variety of applications. So, for example, if it were desired to provide a dual chamber container having the exactly measured ingredients of a mixed drink, one compartment might have a two-thirds(⅔) volume of mixer (seltzer) and the other compartment one-third (⅓) volume of liquor. Typically, the volume of Sections I and II would be adjusted accordingly by axially repositioning the divider 36 along the longitudinal length of the container.

Both end surfaces (18, 20) of the cylindrically shaped wall portion 14 are symmetrical so that the container may be stably positioned at either of its ends on a flat counter top. A cap 32 having internal threads (not shown) which thread onto matching eternal threads on the opening spout (not shown) of the container is shown affixed at the center of the body portion at either end of the container. So as not to interfere with stability when the container is standing in an upright position, the plane of the top surface of each cap is positioned a distance (approximately 1/16 to 1/8") slightly below the plane of the respective top or bottom end surfaces, 18 or 20 formed by extended wall portion. The planes containing the surfaces 18 and 20 are parallel to each other such that the container is stably positioned irrespective of the surface that is posited on the support surface. A well area 25 formed by the top surface 26 of the upper section 22 of the container can extend up to approximately 2" below the top surface 18 of the wall extension. The top surface 28 of the second section 24 of the container will typically extend the same distance upwards (as viewed in FIG. 2) from approximately 2" the bottom surface 20 of the wall extension at the bottom. This approximate 2" top and bottom extension of the wall portion 14 of the container 10 to form the symmetrical well areas 25 at either end of the container provide a spillage retention area. They also serve as a convenient means for the placement of a two finger aperture 30 in the extension to create an easy-carry handle, and also to form a convenient easy-pour arch 34 within the well area at both ends of the container.

Of course the well area can be substantially reduced, providing more storage volume for the container's contents. This enables a reduction in length of the container if desired, and further enhances stability.

Figure 3:
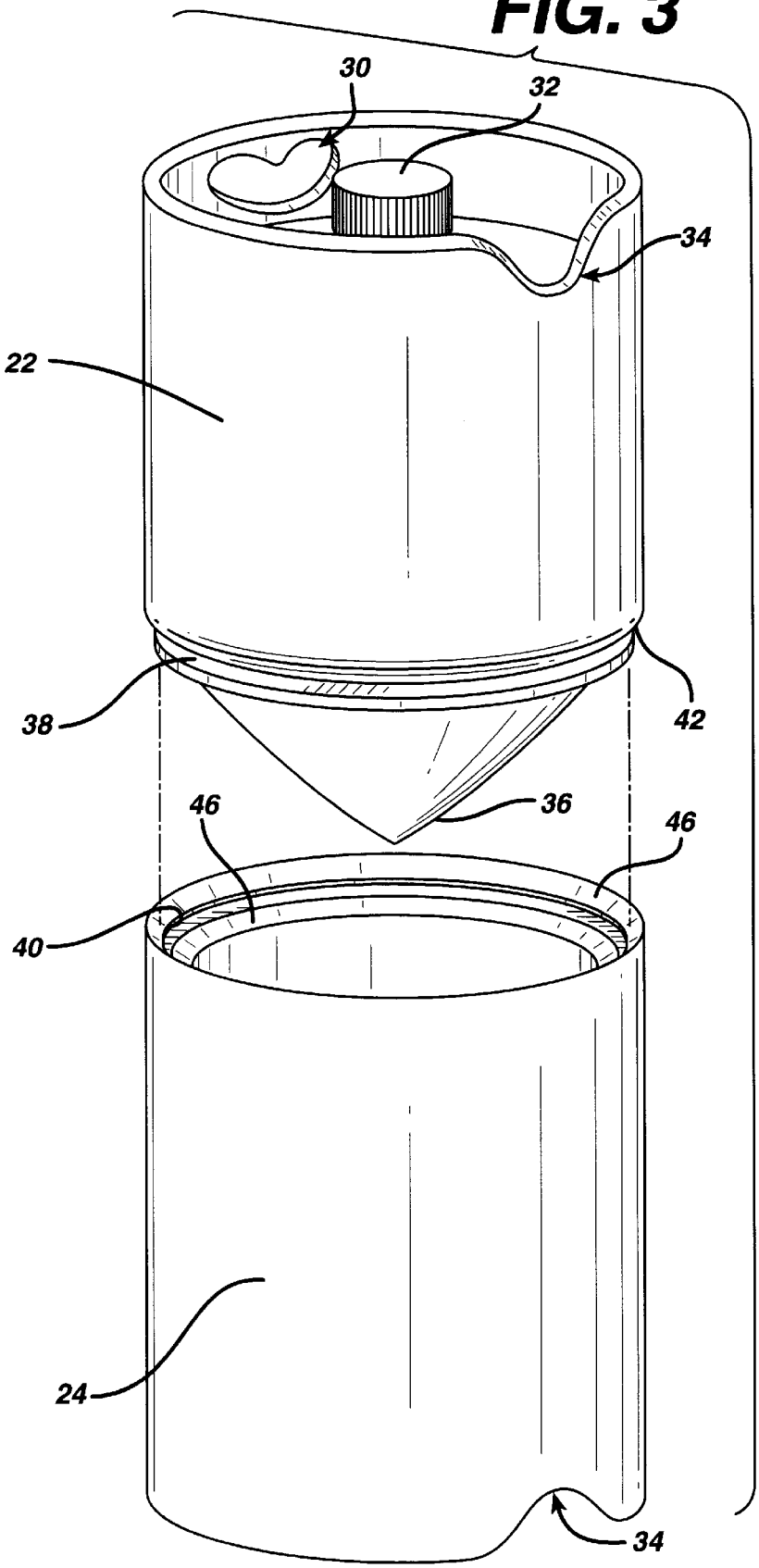
FIG. 3 is an exploded view of one possible fabrication method for the version of the dual chamber container of FIGS. 1 and 2.
Figure 4:
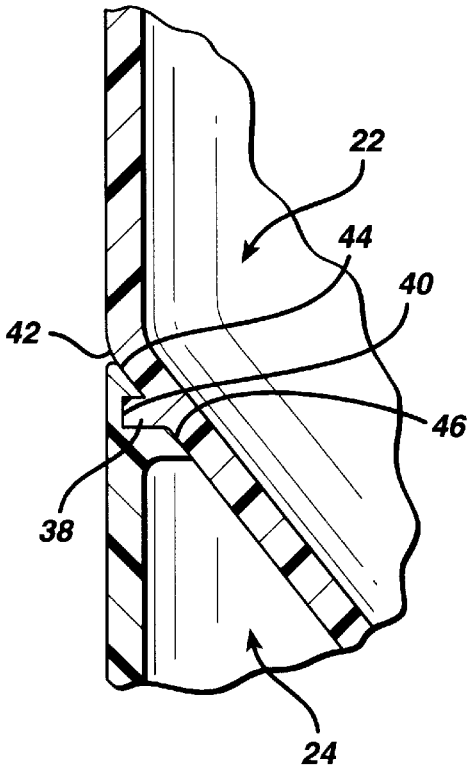
FIG. 4 is a side elevational, sectional view illustrating an adhesive bonding of the tongue and groove configuration illustrated in FIG. 3.
Figure 5:
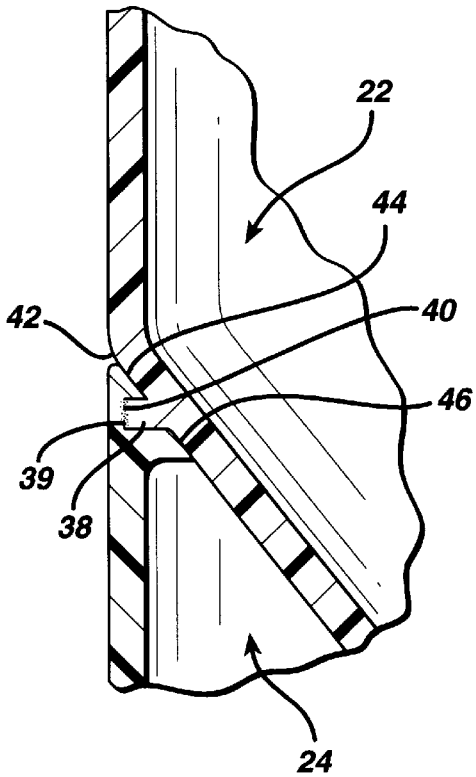
FIG. 5 is a side elevational, sectional view illustrating a thermal bonding of the tongue and groove configuration illustrated in FIG. 3.

FIGS. 3 and 4 illustrate one method for economically fabricating the container 10 of the invention. This method envisions the container formed from two sections (22, 24) with a circumferential "tongue" 38 projection extending from a base portion of the first section 22 immediately adjacent the beginnings of the downwardly projecting (opposite the position of the cap 32 in this first section) cone shaped divider 36. The second section 24 of the container has a cooperating "groove" 40 for accepting the tongue 38 in the first section molded into the bottom peripheral edge of the second section 24. Sliding the oblique angled wall 42 portion of the outer wall 14 into the beveled upper inner wall portion 44 of the inner wall, and beveled lower inner wall portion 46 of the inner wall causes the outwardly projecting tongue 38 to snap fit into groove 40 within the peripheral edge of the second section. The actual sealing of the first 22 and second 24 sections together can be accomplished by conventional adhesive bonding (not shown), or by heat sealing as at 39 in FIG. 5.

Figure 6:
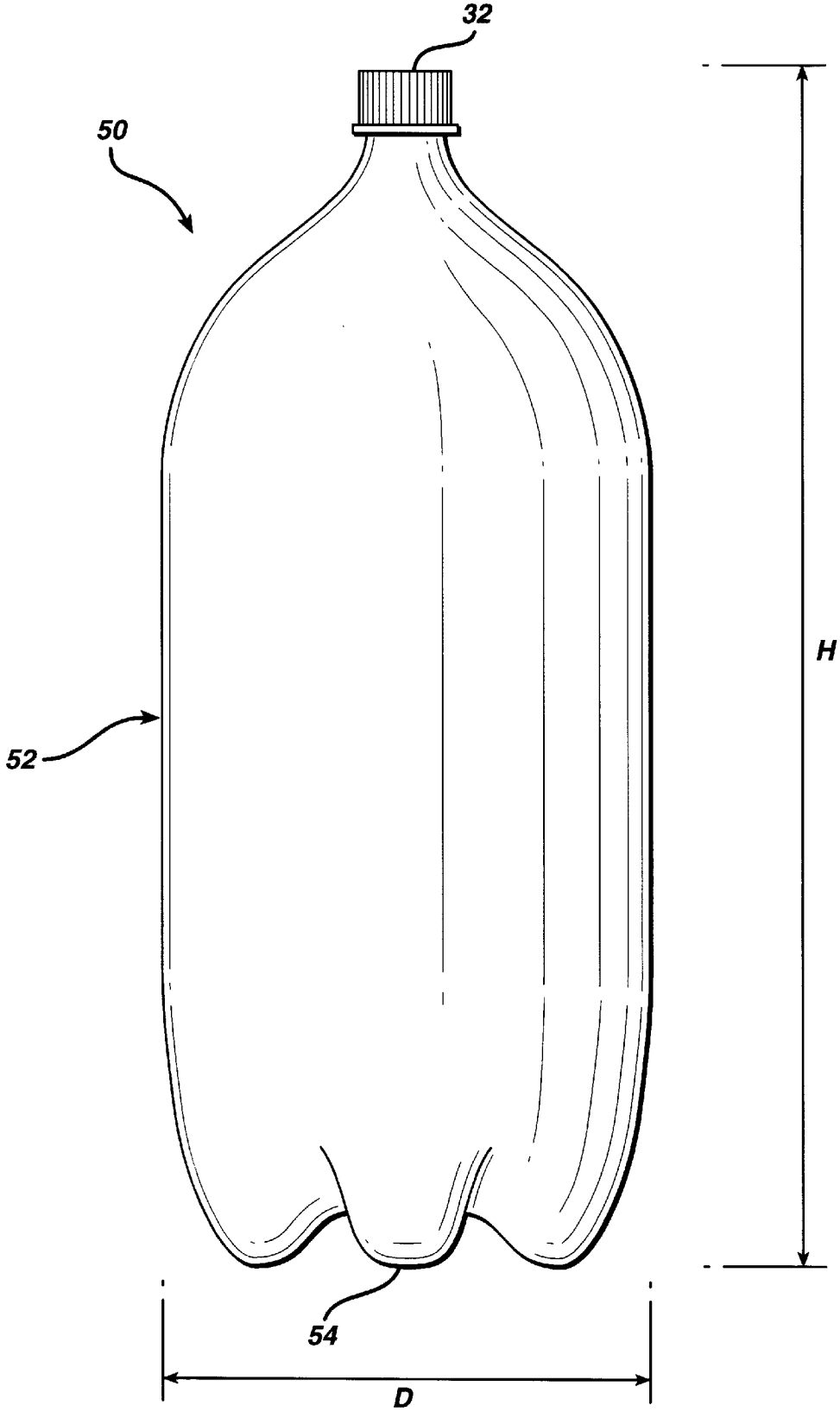
FIG. 6 PRIOR ART
FIG. 6 is a perspective view of a typical two liter plastic container of the prior art.

In FIG. 6 a typical two liter container 50 of the prior art is illustrated. The container is generally cylindrical in shape 52, having a plurality of molded indents 54 at its base to aid stability when standing in an upright position. A standard threaded cap 32 is shown threaded onto the opening spout (not shown).

A comparison of FIGS. 1 and 6 makes readily apparent the advantages of the present invention. The dual chamber container 10 is stable in an upright position regardless of which end is placed on a counter top, with the cap 32 accessibly secured within a well area. Accidental spills occurring when opening the cap and pouring are contained within the respective well area 25. Pouring is facilitated by the easy-pour arch 34. And transport is simplified by the two finger aperture 30. In addition the uniquely configured and positioned divider distributes the overall weight of the container to resist tipping over when the first section 22 is positioned above the second section. And finally, customers can now enjoy greatly enhanced flavor retention of the carbonated beverage of their choice; or selected combinations of fluids, condiments, spices, etc. which experience has taught go hand and hand.

While versions of the present invention have been shown in detail, various modifications and improvements will become readily apparent to those skilled in the art. E.g. the familiar twist spouts for mustard and ketchup can be employed. The top of the two spouts as discussed above would be below the plane of the end surfaces 18 and 20.

Accordingly, the spirit and scope of the present invention is to be limited only by the breadth of the following claims.

What is claimed is:

1. A dual chamber container, comprising:

(a) a body portion, including a first end and a second end, said first end and said second end being directly opposite to one another on said body portion;

(b) a sealable opening disposed at each of said first end and said second end of said body portion;

(c) a divider within said body portion, said divider separating said body portion into an upper section and a lower section, wherein said upper section and said lower section have substantially the same volume, said first end being confluent with said upper section, and said second end being confluent with said lower section;

said body portion including a circumferentially enclosing wall portion extending a spaced distance each of said sealable openings, and wherein said divider includes a peripheral edge, said divider being connected at said peripheral edge to said wall portion, said divider sloping from said wall portion so as to form a downwardly projecting, centrally positioned indent within said lower section of said container, when the container is posited on one of said end surfaces, said wall portion having respective end surfaces at the point of terminating beyond each said sealable opening, each said respective end surface terminating in a plane parallel to the plane containing the other respective end surface, whereby said container can remain in an upright position when posited on either one of said end surfaces; and, (d) a respective well area disposed between each said extension of said wall portion and each of said sealable openings wherein spillage is retained.

2. The dual chamber container according to claim 1 wherein said wall portion at both ends of said body portion further include a respective pour arch configuration.

3. The dual chamber container according to claim 1 wherein said wall portion at both ends of said body portion further include a respective two finger aperture for carrying said container.

4. The dual chamber container according to claim 1 wherein said wall portion is cylindrical in shape throughout its length.

5. The dual chamber container according to claim 1 wherein each of said sealable opening is centrally positioned within its said respective well area, each of said sealable openings being comprised of an externally threaded spout and a cooperating internally threaded cap.

6. The dual chamber container according to claim 1 wherein said container is fabricated in plastic.

7. A dual chamber container, comprising:

(a) a cylindrically shaped body portion, including a first end and a second end, said first end and said second end being directly opposite to one another on said body portion;

(b) a sealable opening disposed at each of said first end and said second end of said body portion;

(c) a divider within said body portion, said divider separating said body portion into an upper section and a lower section, said first end being confluent with said upper section, and said second end being confluent with said lower section;

wherein said upper section and said lower section have substantially the same volume;

said body portion including a circumferentially enclosing wall portion extending a spaced distance beyond each of said sealable openings, said wall portion having respective end surface at the point of terminating beyond each said sealing opening, each said respective end surface terminating in a plane parallel to the plane containing the other respective end surface, whereby said container can remain in an upright position when posited on either one of said end surfaces;

wherein said divider includes a peripheral edge, said divider being connected at said peripheral edge to said wall portion, wherein said divider is in the shape of a cone, with the apex of said cone positioned equidistantly between said wall portion of said body portion; and, (d) a respective well area disposed between each said extension of said wall portion and each of said sealable openings wherein spillage is retained.

8. The dual chamber container according to claim 7 wherein said wall portion at both ends of said body portion further include a respective pour arch configuration.

9. The dual chamber container according to claim 7 wherein said wall portion at both ends of said body portion further include a respective two finger aperture for carrying said container.

10. A dual chamber container according to claim 7 wherein said container is fabricated from plastic.

11. A dual chamber container, comprising:

(a) a body portion, including a first end and a second end, said first end and said second end being directly opposite to one another on said body portion;

(b) a sealable opening disposed at each of said first end and said second end of said body portion;

(c) a divider within said body portion, said divider separating said body portion into an upper section and a lower section, said first end being confluent with said upper section, and said second end being confluent with said lower section;

said body portion including a circumferentially enclosing wall portion extending a spaced distance beyond each of said sealable openings, and wherein said divider includes a peripheral edge, said divider being connected at said peripheral edge to said wall portion, said divider sloping from said wall portion so as to form a downwardly projecting, centrally positioned indent within said lower section of said container, when the container is posited on one of said end surfaces, wherein said divider is in th shape of a cone, wherein said indent is the apex of said cone, the apex of said cone positioned equidistantly between said wall portion of said body portion, said wall portion having respective end surfaces at the point of terminating beyond each said sealable opening, each said respective end surface terminating in a plane parallel to the plane containing the other respective end surface, whereby said container can remain in an upright position when posited on either one of said end surfaces; and, (d) a respective well area disposed between each said extension of said wall portion and each of said sealable openings wherein spillage is retained.

12. The dual chamber container according to claim 11 wherein said upper section and said lower section have substantially the same volume.

* * * * *

UNITED STATES PATENT AND TRADEMARK OFFICE

CERTIFICATE OF CORRECTION

PATENT NO. : 6,105,812
DATED : August 22, 2000
INVENTOR(S) : Dennis Riordan, Congers, New York It is certified that error appears in the above-identified patent and that said Letters Patent is hereby corrected as shown below:

IN THE CLAIMS:

Column 6,
Line 19, add the word -- beyond -- after the word "distance".
Line 49, delete the word "of" after the word "each" and before the word "said".

Signed and Sealed this

Seventh Day of August, 2001

*Attest:*

Nicholas P. Godici

*Attesting Officer*

NICHOLAS P. GODICI
*Acting Director of the United States Patent and Trademark Office*